US008220093B2

(12) United States Patent
Bae et al.

(10) Patent No.: US 8,220,093 B2
(45) Date of Patent: Jul. 17, 2012

(54) WASHING MACHINE AND METHOD OF CONTROLLING A WASHING MACHINE

(75) Inventors: Sun Cheol Bae, Changwon-si (KR); Kyung Hoon Kim, Changwon-si (KR); Han Su Jung, Changwon-si (KR); Jae Hyeok Choi, Changwon-si (KR); Ja In Koo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 303 days.

(21) Appl. No.: 12/470,818

(22) Filed: May 22, 2009

(65) Prior Publication Data

US 2009/0293205 A1 Dec. 3, 2009

(30) Foreign Application Priority Data

May 23, 2008 (KR) ..... 10-2008-0048185

(51) Int. Cl.
*D06F 33/02* (2006.01)

(52) U.S. Cl. ..... 8/159; 68/12.06

(58) Field of Classification Search ..... 8/158, 159; 68/12.06

See application file for complete search history.

(56) References Cited

U.S. PATENT DOCUMENTS

| | | | | |
|---|---|---|---|---|
| 3,301,024 | A | 1/1967 | Smith | 68/12 |
| 4,782,544 | A * | 11/1988 | Nystuen et al. | 8/159 |
| 5,207,764 | A | 5/1993 | Akabane et al. | |
| 5,692,313 | A | 12/1997 | Ikeda et al. | 34/58 |
| 5,768,730 | A | 6/1998 | Matsumoto et al. | 8/159 |
| 5,887,456 | A | 3/1999 | Tanigawa et al. | 68/20 |
| 6,029,299 | A * | 2/2000 | Baek et al. | 8/159 |
| 6,240,586 | B1 | 6/2001 | Joo | 8/159 |
| 6,381,791 | B1 * | 5/2002 | French et al. | 8/159 |
| 6,578,225 | B2 | 6/2003 | Jönsson | 8/159 |
| 7,412,740 | B2 * | 8/2008 | Park et al. | 8/159 |
| 7,478,547 | B2 | 1/2009 | Okazaki et al. | 68/12.04 |
| 7,490,490 | B2 | 2/2009 | Hirasawa et al. | 68/12.04 |
| 7,530,133 | B2 * | 5/2009 | Mitts | 8/159 |
| 7,627,920 | B2 * | 12/2009 | Wong et al. | 8/159 |
| 2003/0140427 | A1 | 7/2003 | Yamamoto et al. | 8/159 |
| 2005/0102766 | A1 | 5/2005 | Vande Haar et al. | 8/159 |
| 2005/0251926 | A1 | 11/2005 | Lee et al. | |

(Continued)

FOREIGN PATENT DOCUMENTS

CA 2 360 476 C 5/2002

(Continued)

OTHER PUBLICATIONS

Chinese Office Action dated Aug. 19, 2010 issued in Application No. 200910141732.1.

(Continued)

*Primary Examiner* — Frankie L Stinson
(74) *Attorney, Agent, or Firm* — KED & Associates LLP

(57) ABSTRACT

The present invention relates to a washing machine and a method of controlling the washing machine. According to a washing machine and a method of controlling the washing machine in accordance with the present invention, a drum operates at a first speed so that part of the laundry tumbles within the drum and another part of the laundry adheres to the drum. The laundry amount within the drum is sensed during the first speed operation. Operation commands for driving the drum after the first speed operation are changed based on the sensed laundry amount. Accordingly, at the time of the dehydration cycle, stability of the washing machine and laundry balancing can be ensured.

21 Claims, 7 Drawing Sheets

U.S. PATENT DOCUMENTS

| | | | | |
|---|---|---|---|---|
| 2005/0268670 | A1 | 12/2005 | Hirasawa et al. | 68/12.06 |
| 2006/0005319 | A1 * | 1/2006 | Park | 8/158 |
| 2006/0107299 | A1 | 5/2006 | Bartfeld et al. | 75/110 |
| 2006/0185095 | A1 | 8/2006 | Mitts | 8/158 |
| 2006/0207299 | A1 * | 9/2006 | Okazaki et al. | 68/12.02 |
| 2008/0289118 | A1 * | 11/2008 | Park et al. | 8/159 |
| 2009/0307851 | A1 | 12/2009 | Bae et al. | 8/159 |

FOREIGN PATENT DOCUMENTS

| | | | | |
|---|---|---|---|---|
| CN | 1966812 | A | | 5/2007 |
| DE | 36 06 819 | A1 | | 9/1987 |
| DE | 38 40 265 | A1 | | 5/1990 |
| DE | 41 22 307 | A1 | | 1/1993 |
| DE | 42 29 646 | A1 | | 3/1994 |
| DE | 44 38 760 | A1 | | 5/1996 |
| DE | 102 34 373 | A1 | | 2/2004 |
| DE | 10 2006 017 530 | A1 | | 10/2007 |
| EP | 1 516 952 | A2 | | 3/2005 |
| EP | I 538 251 | A2 | | 6/2005 |
| EP | 1 760 181 | A1 | | 3/2007 |
| GB | 2 327 502 | A | | 1/1999 |
| JP | 01-268597 | | * | 10/1989 |
| JP | 02-136173 | A | | 5/1990 |
| JP | 04-176494 | A | | 6/1992 |
| JP | 06-218181 | A | | 8/1994 |
| JP | 08-299660 | A | | 11/1996 |
| JP | 10-005485 | | * | 1/1998 |
| JP | 10-127978 | | * | 5/1998 |
| JP | 10-216391 | A | | 8/1998 |
| JP | 11-216296 | | * | 8/1999 |
| JP | 2000-157788 | A | | 6/2000 |
| JP | 2001-224889 | | * | 8/2001 |
| JP | 2005-199090 | A | | 7/2005 |
| JP | 2008-054960 | | * | 3/2008 |
| KR | 10-1994-0015033 | A | | 7/1994 |
| KR | 10-2000-0033342 | A | | 6/2000 |
| KR | 10-2001-0004704 | A | | 1/2001 |
| KR | 10-2004-0046049 | A | | 6/2004 |
| KR | 10-2005-0012524 | A | | 2/2005 |
| KR | 10-2005-0042945 | A | | 5/2005 |
| KR | 10-2006-0049526 | A | | 5/2006 |
| WO | WO 00/28128 | A1 | | 5/2000 |
| WO | WO 2004/009899 | A1 | | 1/2004 |
| WO | WO 2005/106096 | A1 | | 11/2005 |

OTHER PUBLICATIONS

Canadian Office Action dated May 30, 2011 issued in Application No. 2,666,777.
Canadian Office Action dated May 30, 2011 issued in Application No. 2,666,779.
U.S. Office Action dated Jul. 19, 2011 issued in U.S. Appl. No. 12/466,495.
Korean Office Action dated Mar. 29, 2010 issued in Application No. 10-2008-0048182.
Korean Office Action dated Mar. 16, 2010 issued in Application No. 10-2008-0048186.
European Search Report dated Sep. 11, 2009 issued in Application No. 09 16 0861.
European Search Report dated Aug. 6, 2009 issued in Application No. 09 16 0863.
Korean Office Action dated Mar. 29, 2010 for Application No. 10-2008-0048184.
Korean Office Action dated Mar. 30, 2010 for Application No. 10-2008-0048183.
Korean Office Action dated Mar. 16, 2010 for Application No. 10-2008-0048185.
Korean Office Action dated Mar. 16, 2010 for Application No. 10-2008-0048277.
Chinese Office Action dated Oct. 20, 2010 issued in Application No. 200910141728.6.
U.S. Office Action dated Oct. 31, 2011 issued in U.S. Appl. No. 12/466,513.
German Office Action dated Jul. 5, 2011 issued in Application No. 10 2009 021 942.0.
German Office Action dated Jul. 5, 2011 issued in Application No. 10 2009 021 947.1.
German Office Action dated Jul. 8, 2011 issued in Application No. 10 2009 021 941.2.
German Office Action dated Jul. 8, 2011 issued in Application No. 10 2009 021 949.8.
United States Office Action dated Aug. 23, 2011 issued in U.S. Appl. No. 12/470,804.
United States Office Action dated Aug. 24, 2011 issued in U.S. Appl. No. 12/470,800.
United States Office Action dated Aug. 24, 2011 issued in U.S. Appl. No. 12/470,815.
U.S. Office Action dated Jan. 10, 2012 in U.S. Appl. No. 12/466,495.
U.S. Office Action dated Mar. 6, 2012 in U.S. Appl. No. 12/470,800.
U.S. Office Action dated Mar. 12, 2012 in U.S. Appl. No. 12/470,815.
U.S. Office Action dated Apr. 5, 2012 in U.S. Appl. No. 12/466,513.

* cited by examiner

WASHING MACHINE AND METHOD OF CONTROLLING A WASHING MACHINE

This application claims priority from Korean Patent Application No. 10-2008-0048185, filed May 23, 2008, the subject of which is incorporated herein by reference.

BACKGROUND

1. Field

Embodiments of the present invention may relate to a washing machine and a method of controlling the washing machine and, more particularly, to a washing machine with improved stability and improved laundry balancing at the time of a dehydration cycle, and a method of controlling a washing machine.

2. Background

A drum-type washing machine of washing machines is configured to perform washing by employing a drum that rotates by driving force of a motor and frictional force of the laundry in the state in which a detergent, wash water, and the laundry are input to the drum. Thus, the drum-type washing machine does rarely damage the laundry, has the laundry rarely get entangled, and has knocking and rubbing washing effects.

After wash and rinse cycles are finished, a dehydration cycle is performed. In order to perform the dehydration cycle, laundry must be distributed effectively. To this end, a variety of methods have been used. For example, a method of determining an unbalance amount in the state in which laundry is adhered to the drum was used. However, this method is disadvantageous in that it has a long balancing time of laundry and the state of laundry is decided by sensing an unbalance amount of the laundry in the state in which the laundry is adhered to the drum. Further, in the case in which laundry is unbalanced with the laundry being adhered to the drum, it becomes problematic in the stability of a washing machine.

BRIEF DESCRIPTION OF THE DRAWINGS

Objects and features of arrangements and embodiments of the present invention may become apparent from the following description taken in conjunction with the accompanying drawings, in which like reference numerals refer to like elements and wherein.

DETAILED DESCRIPTION

Arrangements and embodiments of the present invention may be described in detail with reference to the accompanying drawings.

Figure 1:
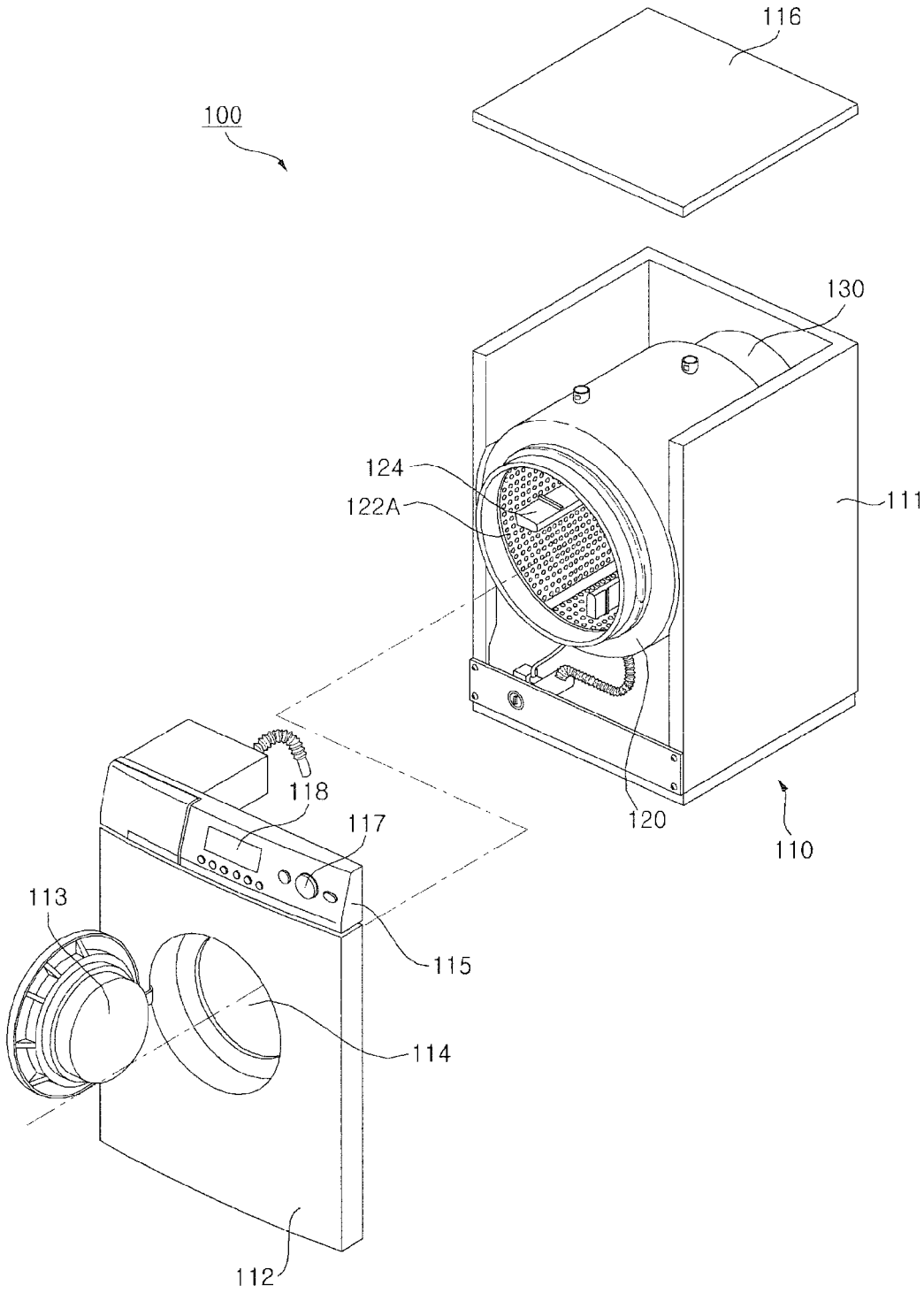
FIG. 1 is a perspective view showing a washing machine in accordance with an embodiment of the present invention.

FIG. 1 is a perspective view showing a washing machine in accordance with an embodiment of the present invention.

Description is given below with reference to the drawing. A washing machine 100 includes a cabinet 110 forming an external shape of the washing machine 100, a tub 120 disposed within the cabinet 110 and supported by the cabinet 110, a drum 122 disposed within the tub 120 in which laundry is washed, a motor 130 for driving the drum 122, a wash water supply apparatus (not shown) disposed outside a cabinet main body 111 and configured to supply wash water to the cabinet 110, and a drain apparatus (not shown) formed under the tub 120 and configured to drain wash water to the outside.

A plurality of through-holes 122A for having wash water pass therethrough is formed in the drum 122. Lifters 124 can be disposed within the drum 112 so that the laundry is raised up to a specific height when the drum 122 is rotated and then dropped because of gravity.

The cabinet 110 includes the cabinet main body 111, a cabinet cover 112 disposed on the front side of the cabinet main body 111 and coupled thereto, a control panel 115 disposed on an upper side of the cabinet cover 112 and coupled to the cabinet main body 111, and a top plate 116 disposed at the top of the control panel 115 and coupled to the cabinet main body 111.

The cabinet cover 112 includes a laundry inlet/outlet hole 114 formed to have laundry pass therethrough, and a door 113 disposed rotatably left and right so that the laundry inlet/outlet hole 114 is opened and closed.

The control panel 115 includes a control button 117 for manipulating operating states of the washing machine 100, and a display device 118 disposed on one side of the control button 117 and configured to display operating states of the washing machine 100.

The control button 117 and the display device 118 within the control panel 115 are electrically connected to a controller (not shown). The controller (not shown) electrically controls respective constituent elements, etc. of the washing machine 100. An operation of the controller (not shown) is described later on.

Figure 2:
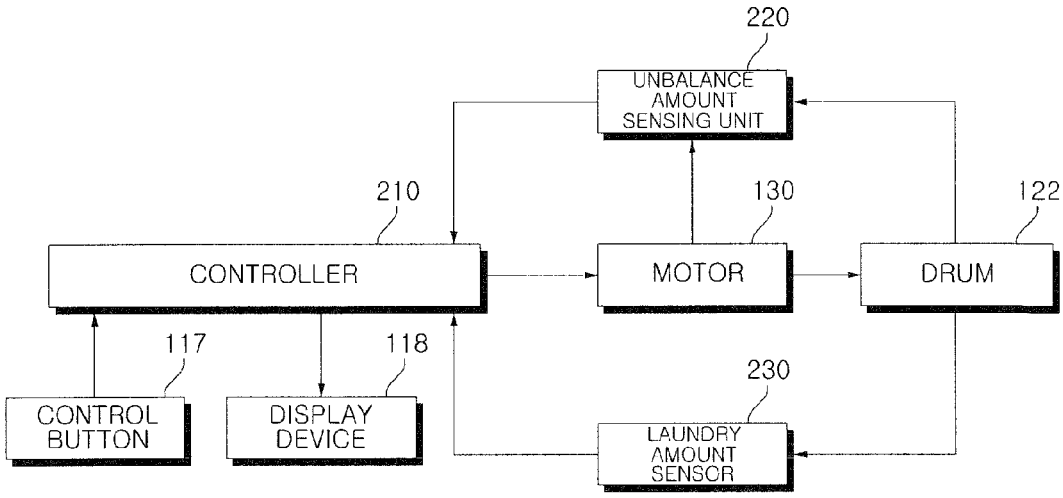
FIG. 2 is an internal block diagram of the washing machine shown in FIG. 1.

FIG. 2 is an internal block diagram of the washing machine shown in FIG. 1.

Description is given below with reference to the drawing. First, a controller 210 operates in response to an operation signal received from the control button 117. Thus, actual washing, rinse, and dehydration cycles can be performed. For the actual washing, rinse, and dehydration cycles, the controller 210 controls the motor 130. Although not shown in the drawings, an inverter (not shown) can be used to control the motor. For example, when the controller 210 outputs a PWM switching control signal to the inverter (not shown), the inverter (not shown) can perform a high-speed switching operation in order to supply an AC power of a specific frequency to the motor 130.

Meanwhile, the controller 210 can display operating states of the washing machine 100 through the display device 118. For example, the controller 210 can display operating states, such as actual washing, rinse, and dehydration cycles, through the display device 118.

The motor 130 drives the drum 122. The drum 122 is disposed within the tub 120, as shown in FIG. 1, and has laundry for washing input therein. The drum 122 is driven by the rotation of the motor 130.

An unbalance amount sensing unit 220 senses an unbalance amount of the drum 122, that is, unbalance (UB) of the drum 122. The unbalance amount can be sensed based on a rotational speed variation of the drum 122, that is, a rotational speed variation of the motor 130. To this end, a speed sensor (not shown) for sensing a rotational speed of the motor 130 can be further included. Meanwhile, a rotational speed of the motor 130 can be calculated based on an output current value flowing through the motor 130, and an unbalance amount can be sensed based on the rotational speed. To this end, the motor 130 can include a current sensor (not shown), for example, an encoder.

Meanwhile, although it is shown that the unbalance amount sensing unit 220 is provided separately from the controller 210, the present invention is not limited to the above example. Alternatively, the unbalance amount sensing unit 220 may be included within the controller 210. In this case, a rotational speed and an output current value of the motor 130, which are respectively sensed by the speed sensor (not shown) and the current sensor (not shown), can be input to the controller 210.

Meanwhile, the washing machine can further include a laundry amount sensor 230. The laundry amount sensor 230 senses the laundry amount within the drum and inputs a sensed laundry amount to the controller 210. Such sensing of the laundry amount can be performed by sensing the weight of laundry within the drum 122, a rotational speed of the drum 122, and the like anytime when the drum is stopped or operated. The laundry amount sensor 230 is illustrated in FIG. 2 as being separate from the controller 210. However, the laundry amount sensor 230 may be included within the controller 210.

Figure 3:
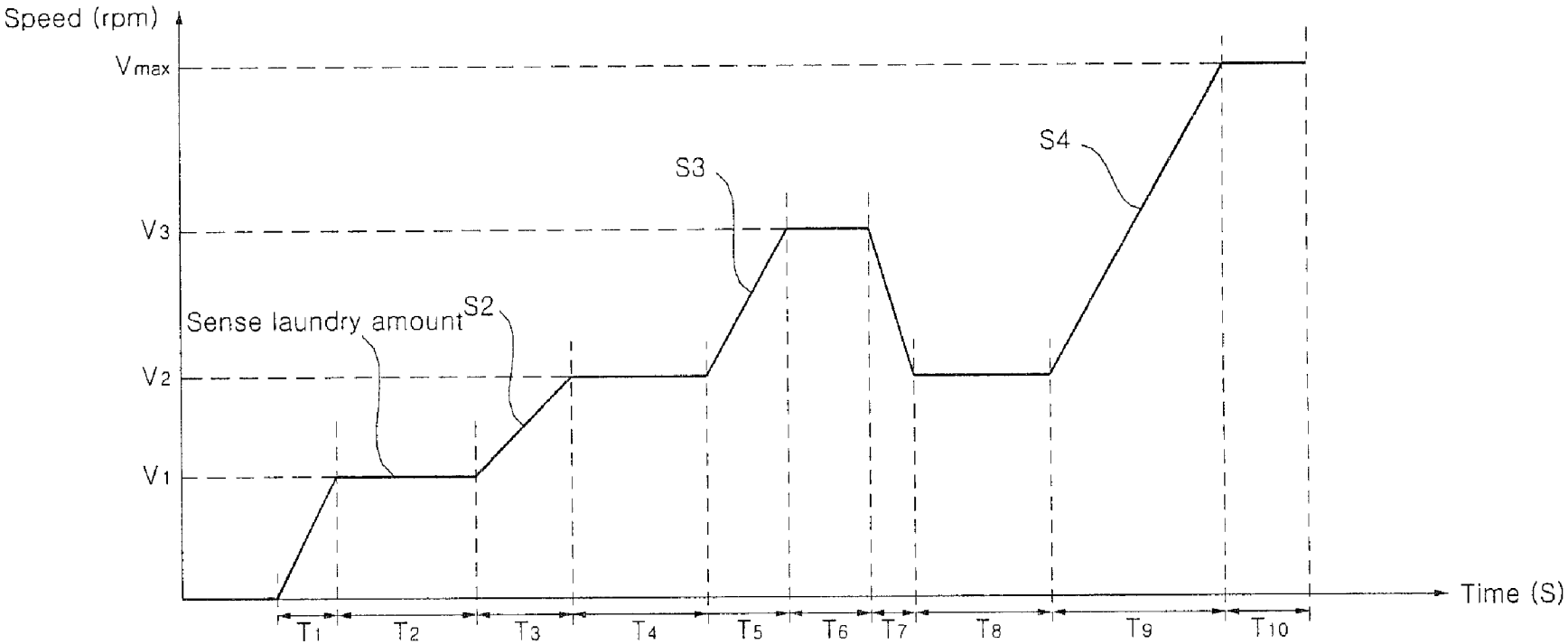
FIG. 3 is a graph showing an example of the relationship between a rotational speed of a drum within the washing machine shown in FIG. 1 and time.
Figure 4:
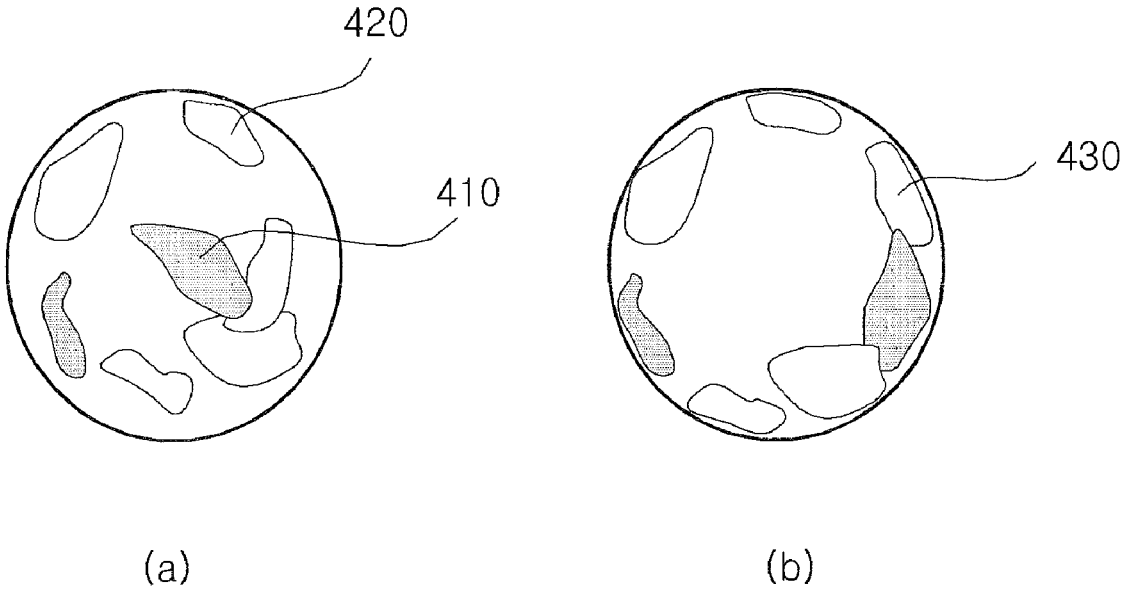
FIG. 4 is a diagram showing the states of laundry within the drum of FIG. 3 according to a first speed and a second speed.

FIG. 3 is a graph showing an example of the relationship between a rotational speed of the drum and time within the washing machine of FIG. 1. FIG. 4 is a diagram showing the states of laundry within the drum of FIG. 3 according to a first speed and a second speed.

Description is given below with reference to the accompanying drawings. In relation to the dehydration cycle of the washing machine in accordance with an embodiment of the present invention, the rotational speed of the drum 122 is first raised to a first speed V1 during a first period T1. Here, the first speed V1 is, as shown in FIG. 4(*a*), a speed at which a part 410 of laundry is tumbled within the drum and the other part 420 of the laundry is adhered within the drum. For example, the first speed V1 may be a speed at which 20 to 30% of a total of laundry is tumbled within the drum and 70 to 80% of the total of laundry is adhered within the drum.

During a second period T2, the drum 122 is operated at the first speed V1. When the drum is operated at the first speed V1, the laundry amount sensor 230 senses the amount of the laundry. The controller 210 controls set values, which will be subsequent to the first speed V1, to change according to a sensed laundry amount. The set values are operation commands to decide the operating states of the drum 122. The set values can include a rising slope S2 of a second speed V2 (that is, a speed at which laundry are adhered within the drum), an unbalance amount reference value of at the second speed V2, a rising slope S3 of a third speed V3, which has a resonant speed or less at which the water drain process (small-scale dehydration) is performed, an unbalance amount reference value at the third speed V3, a rising slope S4 of a maximum speed Vmax of the drum at which a full-scale dehydration process is performed, the maximum speed Vmax, and so on. What the operation commands posterior to the first speed V1 are changed according to a sensed laundry amount is described later on.

When the unbalance amount sensed by the unbalance amount sensing unit 220 is a first specific value or less (that is, the rotational speed of the drum has been stabilized), the rotational speed of the drum 122 is raised to the second speed V2. Here, the second speed V2 is a speed at which the entire laundry 430 are adhered within the drum 122, as shown in FIG. 4(*b*).

The second speed rising slope S2 during a third period T3 may be changed according to a laundry amount sensed during the first speed (V1) operation, as described above. For example, as the sensed laundry amount increases, the second speed slope S2 may become gentle (that is, small) so as to stabilize the washing machine 100 and ensure laundry balancing. Alternatively, the second speed slope S2 may also be changed according to the type of laundry, the state of laundry, and so on as well as a sensed laundry amount.

During a fourth period T4, the drum 122 is operated at the second speed V2. During the second speed (V2) operation, an unbalance amount is sensed. When the sensed unbalance amount is a second specific value or less, the operation speed of the drum 122 can be raised to the third speed V3 or the maximum speed Vmax. At this time, the second specific value can be changed according to a laundry amount sensed during the first speed (V1) operation. For example, as the sensed laundry amount increases, the second specific value may become small so as to stabilize the washing machine 100 and ensure laundry balancing. Alternatively, the second specific value may also be changed according to the type of laundry, the state of laundry, and so on as well as a sensed laundry amount.

The third speed rising slope S3 during a fifth period T5 can be changed according to a laundry amount sensed during the first speed (V1) operation, as described above. For example, as the sensed laundry amount increases, the third speed rising slope S3 may become gentle (that is, small) so as to stabilize the washing machine 100 and ensure laundry balancing. Alternatively, the third speed rising slope S3 may also be changed according to the type of laundry, the state of laundry, and so on as well as a sensed laundry amount.

The drum 122 is operated at the third speed V3 during a sixth period T6. The third speed V3 is a speed at which the water drain process is carried out. The third speed V3 can be set to a resonant speed or less.

During the third speed (V3) operation, an unbalance amount is sensed. A third specific value (that is, a reference value of the unbalance amount) can be changed according to a laundry amount sensed during the first speed (V1) operation. For example, as the sensed laundry amount increases, the third specific value may become small so as to stabilize the washing machine 100 and ensure laundry balancing. Alternatively, the third specific value may also be changed according to the type of laundry, the state of laundry, and so on as well as a sensed laundry amount.

During a seventh period T7, the rotational speed of the drum 122 drops to the second speed V2. During an eighth period T8, the drum is operated at the second speed V2. As described above, after the water drain process is performed, the rotational speed of the drum 122 drops to the second speed V2 again so that the laundry are adhered within the drum 122. The fifth to eighth periods T5 to T8 (that is, the water drain process) may be performed at least once.

Next, when an unbalance amount during the second speed (V2) operation is the second specific value or less, the rotational speed of the drum rises to the maximum speed Vmax during a ninth period T9. At this time, the maximum speed rising slope S4 during the ninth period T9 can be changed according to a laundry amount sensed during the first speed (V1) operation, as described above. For example, as the sensed laundry amount increases, the maximum speed rising slope S4 may become gentle (that is, small) so as to stabilize the washing machine 100 and ensure laundry balancing.

Alternatively, the maximum speed rising slope S4 may also be changed according to the type of laundry, the state of laundry, and so on as well as a sensed laundry amount.

During a tenth period T10, the drum 122 is operated at the maximum speed Vmax. This process is a process for full-scale dehydration. After laundry balancing within the drum 122 is completed, the full-scale dehydration process begins. Here, the maximum speed Vmax can be changed according to a laundry amount sensed during the first speed (V1) operation. For example, as the sensed laundry amount increases, the maximum speed Vmax may become small so as to stabilize the washing machine 100 and ensure laundry balancing. Alternatively, the maximum speed Vmax may also be changed according to the type of laundry, the state of laundry, and so on as well as a sensed laundry amount.

As described above, operation commands posterior to the first speed V1 are changed according to a laundry amount sensed at the first speed V1. Accordingly, stability of the washing machine 100 and balancing of laundry at the time of the dehydration cycle can be ensured.

Meanwhile, the drum 122 can be driven at the first speed V1 at which a part of laundry is tumbled so as to meet the balancing state of the laundry to some extent, not at a speed at which the entire laundry are tumbled as in the prior art, and the drum can be then operated at the second speed V2. Accordingly, laundry can be distributed accurately and rapidly.

Meanwhile, the above first speed V1 may be about 60 rpm, the second speed V2 may be about 108 rpm, the third speed V3 may be 300 rpm or more, and the maximum speed Vmax may be 500 rpm or more.

Figure 5:
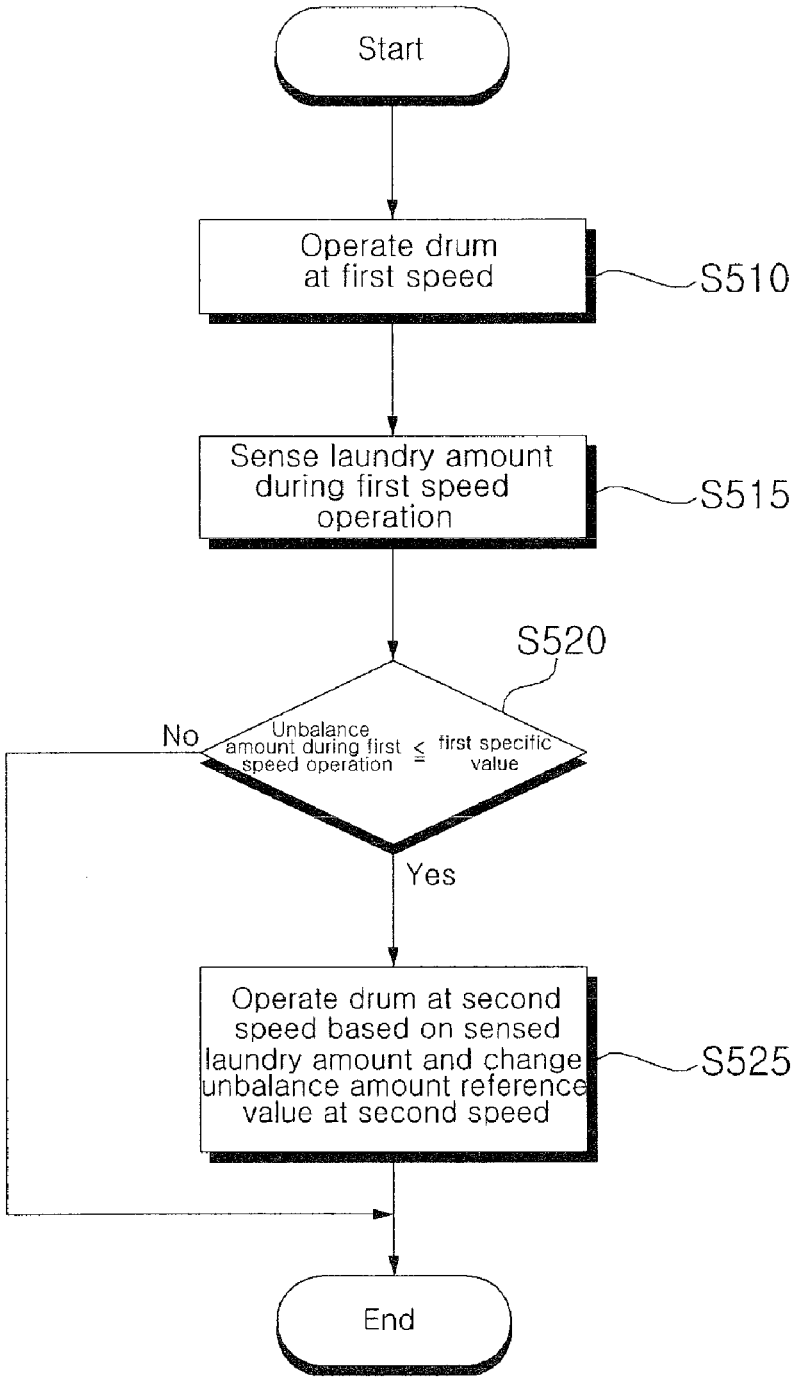
FIG. 5 is a flowchart illustrating a method of controlling the washing machine in accordance with an embodiment of the present invention.

FIG. 5 is a flowchart illustrating a method of controlling the washing machine in accordance with an embodiment of the present invention.

Description is given below with reference to the accompanying drawings. The controller 210 controls the drum 122 to operate at the first speed V1 in step S510. As shown in FIG. 3, the rotational speed of the drum 122, being in a stop state, is raised to the first speed V1 and then operated at the first speed V1. Here, the first speed V1 is a speed at which a part 410 of laundry is tumbled within the drum and the other part 420 of the laundry is adhered within the drum. For example, the first speed V1 may be a speed at which 20 to 30% of a total of laundry is tumbled within the drum and 70 to 80% of the total of laundry is adhered within the drum.

The controller 210 then senses a laundry amount during the first speed (V1) operation in step S515. The sensing of the laundry amount is performed by the laundry amount sensor 230.

Next, the controller 210 determines whether an unbalance amount during the first speed (V1) operation is a first specific value or less in step S520. That is, the controller 210 determines whether an unbalance amount sensed by the unbalance amount sensing unit 220 is a first specific value or less.

If, as a result of the determination, the unbalance amount during the first speed (V1) operation is the first specific value or less, the controller 210 operates the drum at the second speed V2 in step S525. Here, the second speed V2 is, as shown in FIG. 4(*b*), a speed at which the entire laundry 430 are adhered within the drum 122.

Meanwhile, when an unbalance amount of the second speed is a second specific value or less (that is, a reference value), the rotational speed of the drum can rise to the third speed V3 or the maximum speed Vmax. Here, the second specific value can be changed according to a laundry amount sensed at the first speed V1. For example, as the sensed laundry amount increases, the second specific value may become small. Therefore, stabilization of the washing machine 100 and laundry balancing can be ensured.

Figure 6:
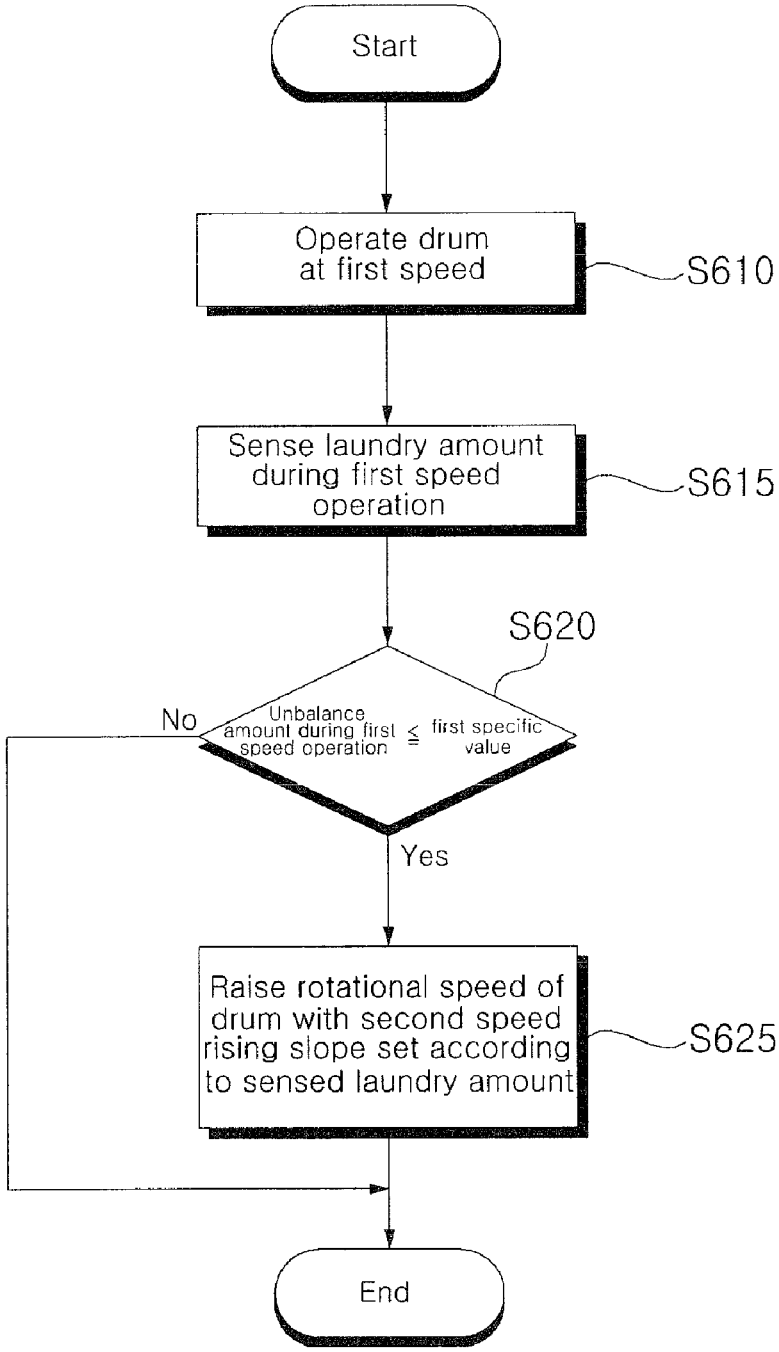
FIG. 6 is a flowchart illustrating a method of controlling the washing machine in accordance with an embodiment of the present invention.

FIG. 6 is a flowchart illustrating a method of controlling the washing machine in accordance with an embodiment of the present invention.

Description is given below with reference to the drawings. The control method of FIG. 6 is almost similar to that of FIG. 5. However, the control method of FIG. 6 differs from that of FIG. 5 in that, in the control method of FIG. 5, the second specific value (that is, the unbalance amount reference value at the second speed) is changed according to a laundry amount sensed at the first speed V1, whereas, in the control method of FIG. 6, the second speed rising slope S2 is changed.

That is, a first speed operation process (S610), a laundry amount sensing operation process (S615) during the first speed operation, and an unbalance amount determination process (S620) during the first speed operation are identical to those of FIG. 5. Therefore, the redundant description will be omitted for simplicity.

If an unbalance amount during the first speed operation is a first specific value or less in step S520, the controller 210 raises the rotational speed of the drum 122 to a second speed in step S625. Here, the second speed rising slope S2 can be changed according to a laundry amount sensed at the first speed V1. For example, as the sensed laundry amount increases, the second speed rising slope S2 may become small. Accordingly, the washing machine 100 can be stabilized and laundry balancing can be ensured.

Figure 7:
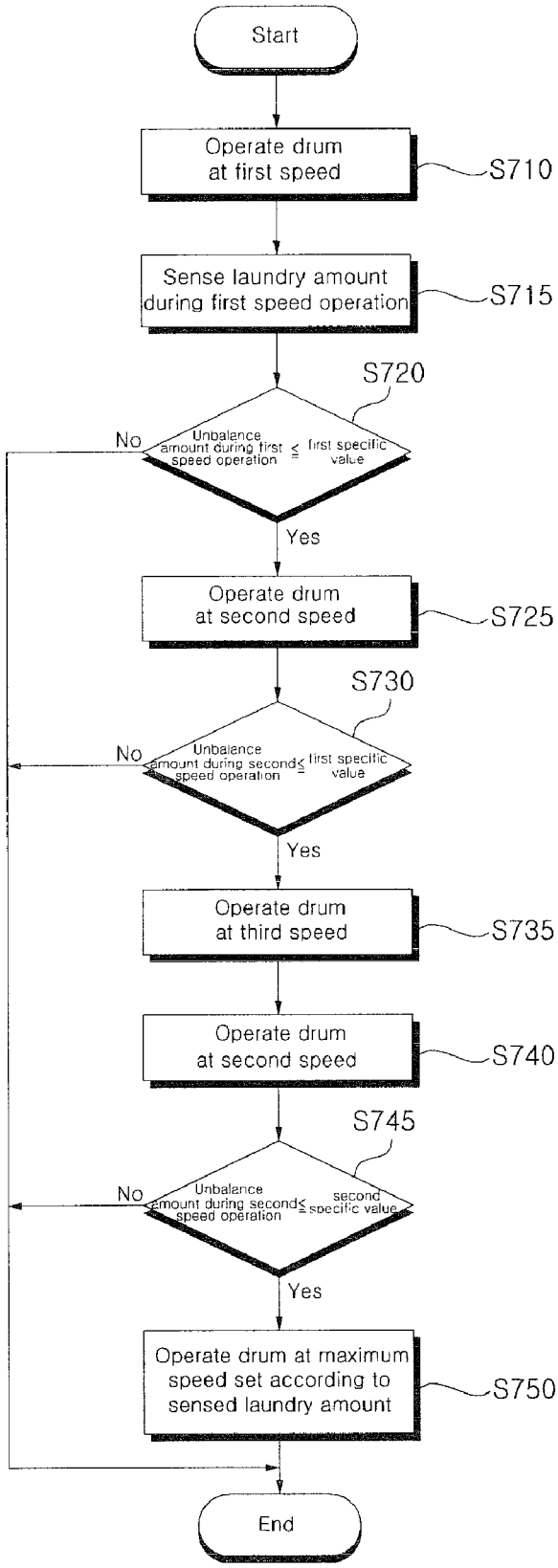
FIG. 7 is a flowchart illustrating a method of controlling the washing machine in accordance with an embodiment of the present invention.

FIG. 7 is a flowchart illustrating a method of controlling the washing machine in accordance with an embodiment of the present invention.

Description is given below with reference to the drawings. The control method of FIG. 7 is almost similar to that of FIG. 5. That is, a first speed operation process (S710), a laundry amount sensing process (S715) during the first speed operation, an unbalance amount determination process (S720) during the first speed operation, and a second speed operation process (S725) are almost similar to those of FIG. 5. Only processes subsequent to the second speed operation process (S725) are described below for simplicity.

The controller 210 determines whether an unbalance amount during the second speed operation is a second specific value or less in step S730. It, as a result of the determination, the unbalance amount during the second speed operation is the second specific value or less, the controller 210 raises the rotational speed of the drum 122 to the third speed V3 and then operates the drum at the third speed V3 in step S735. The third speed V3 may be a speed of a resonant speed or less at which the water drain process (small-scale dehydration) is performed. The water drain process can be performed at least once, for example, three times.

Although not shown in the drawings, the third speed rising slope S3, or a third specific value (that is, an unbalance amount reference value during the third speed (V3) operation) can be changed according to a laundry amount sensed at the first speed V1. For example, as the sensed laundry amount increases, the third speed rising slope S3 or the third specific value may become small.

Next, the controller 210 operates the drum at the second speed V2 again in step S740 and then determines whether an unbalance amount during the second speed (V2) operation is a second specific value or less in step S745. If, as a result of the determination, the unbalance amount is the second specific value or less, the controller 210 raises the rotational speed of the drum 122 to the maximum speed Vmax and then operates the drum at the maximum speed Vmax in step S750.

The maximum speed Vmax is a speed at which the full-scale dehydration process is carried out. The maximum speed Vmax can be changed according to a laundry amount sensed at the first speed V1. For example, as the sensed laundry amount increases, the maximum speed Vmax may become small.

Meanwhile, although not shown in the drawings, the maximum speed rising slope S4 can also be changed. For example, as a sensed laundry amount increases, the maximum speed rising slope S4 can become small.

As described above, several operation command values subsequent to the first speed V3 are changed based on a laundry amount sensed during the first speed (V3) operation. Accordingly, the washing machine 100 can be stabilized and laundry balancing can be ensured.

Meanwhile, the first speed V1 may be about 60 rpm, the second speed V2 may be about 108 rpm, the third speed V3 may be 300 rpm or more, and the maximum speed Vmax may be 500 rpm or more.

Meanwhile, the method of controlling the washing machine in accordance with the present invention can be implemented as a processor-readable code in a recording medium, which can be read by a processor equipped in a washing machine. The processor-readable recording medium can include all kinds of recording devices in which data readable by a processor is stored. For example, the processor-readable recording medium can include ROM, RAM, CD-ROM, magnetic tapes, floppy disks, optical data storages, and so on, and can also be implemented in the form of carrier waves, such as transmission over the Internet. Further, the processor-readable recording medium can be distributed into computer systems connected over a network, so codes readable by a processor can be stored and executed in a distributed manner.

According to the washing machine and the method of controlling the washing machine in accordance with the embodiments of the present invention, operation commands (for example, rising slopes at respective operation speeds, reference values of unbalance amounts at respective operation speeds and the like) subsequent to a first speed may be changed according to a laundry amount sensed during the first speed operation. Accordingly, a washing machine can be stabilized and laundry balancing can be ensured.

The drum may be driven at a first speed at which part of laundry is tumbled within the drum so as to meet the balancing state of the laundry to some extent not at a speed at which the entire laundry are tumbled within the drum as in the prior art, and the drum then enters a second speed. Accordingly, laundry can be distributed accurately and rapidly.

Embodiment of the present invention may provide a washing machine with improved stability and improved laundry balancing at the time of a dehydration cycle, and a method of controlling a washing machine.

An embodiment of the present invention may provide a method of controlling a washing machine including a drum in which laundry are entered and rotated, including the steps of operating the drum at a first speed at which a part of the laundry are tumbled within the drum and the other part of the laundry is adhered within the drum, sensing an amount of the laundry within the drum during the first speed operation, and changing operation commands for driving the drum subsequently to the first speed operation based on the sensed laundry amount.

An embodiment of the present invention may provide a washing machine, including a drum in which laundry are entered and rotated, a laundry amount sensor for sensing an amount of the laundry within the drum, and a controller for controlling the drum to operate at a first speed at which a part of the laundry are tumbled within the drum and the other part of the laundry is adhered within the drum and changing operation commands for driving the drum subsequently to the first speed operation based on a laundry amount sensed during the first speed operation.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of controlling a washing machine that includes a drum, the method comprising:

rotating the drum at a first speed at which a part of laundry within the drum tumbles and another part of the laundry adheres to the drum;

sensing an amount of the laundry within the drum while the drum rotates at the first speed;

detecting an unbalance amount of the drum while the drum rotates at the first speed; and when the detected unbalance amount of the drum is a first specific value or less, increasing a rotational speed of the drum from the first speed to a second speed so that substantially all of the laundry adheres to the drum, and wherein a reference value of an unbalance amount of the drum during the rotation of the drum at the second speed is determined based on the amount of the laundry sensed during the rotation of the drum at the first speed.

2. The method of claim 1, wherein, as the amount of the laundry sensed during the rotation of the drum at the first speed increases, the reference value decreases.

3. The method of claim 1, wherein the first speed is approximately 60 rpm.

4. A method of controlling a washing machine that includes a drum, the method comprising:

rotating the drum at a first speed at which a part of laundry within the drum tumbles and another part of the laundry adheres to the drum;

sensing an amount of the laundry within the drum while the drum rotates at the first speed;

detecting an unbalance amount of the drum while the drum rotates at the first speed; and when the unbalance amount of the drum detected during the rotation of the drum at the first speed is a specific value or less, increasing a rotational speed of the drum from the first speed to a second speed so that substantially all of the laundry adheres to the drum while the drum rotates at the second speed, wherein a rising slope of the rotational speed of the drum from the first speed to the second speed is determined based on the amount of the laundry sensed during the rotation of the drum at the first speed.

5. The method of claim 4, wherein the first speed is approximately 60 rpm.

6. The method of claim 4, wherein, as the amount of the laundry sensed during the rotation of the drum at the first speed increases, the rising slope toward the second speed decreases.

7. The washing machine of claim 4, wherein during the rotation of the drum at the first speed, the part of the laundry that tumbles is located closer to a center of the drum than the part of the laundry that adheres to the drum.

8. The washing machine of claim 7, wherein during the rotation of the drum at the first speed, a center of mass of each article of the laundry that tumbles is located closer to a center of the drum than a center of mass of each article of the laundry that adheres to the drum.

9. The washing machine of claim 4, wherein during the rotation of the drum at the first speed, a part of the laundry within the drum tumbles and another part of the laundry adheres to the drum at each rotational angle of the drum through a full revolution of the drum.

10. A method of controlling a washing machine that includes a drum, the method comprising:

rotating the drum at a first speed at which a part of laundry within the drum tumbles and another part of the laundry adheres to the drum while the drum rotates;

sensing an amount of the laundry within the drum while the drum rotates at the first speed;

detecting an unbalance amount of the drum while the drum rotates at the first speed;

when the unbalance amount of the drum detected during the rotation of the drum at the first speed is a first specific value or less, increasing a rotational speed of the drum from the first speed to a second speed so that substantially all of the laundry adheres to the drum, and rotating the drum at the second speed;

detecting an unbalance amount of the drum during the rotation of the drum at the second speed; and when the unbalance amount of the drum detected during the rotation of the drum at the second speed is a second specific value or less increasing the rotational speed of the drum from the second speed to a maximum speed, wherein the maximum speed is determined based on the amount of the laundry sensed during the rotation of the drum at the first speed.

11. The method of claim 10, wherein, as the amount of the laundry sensed during the rotation of the drum at the first speed increases, the maximum speed decreases.

12. The method of claim 10, wherein the first speed is approximately 60 rpm.

13. A washing machine comprising:

a drum that rotates laundry;

a laundry amount sensor that senses an amount of the laundry within the drum;

a detector that detects an unbalance amount of the drum; and a controller that:

controls the drum to rotate at a first speed at which a part of the laundry within the drum tumbles and another part of the laundry adheres to the drum;

controls the rotation of the drum to be increased from the first speed to a second speed when an unbalance amount of the drum detected during the rotation of the drum at the first speed is a specific value or less; and controls the rotation of the drum at the second speed so that substantially all of the laundry adheres to the drum, wherein the controller sets a reference value of an unbalance amount of the drum during the rotation of the drum at the second speed based on an amount of the laundry sensed during the rotation of the drum at the first speed.

14. The washing machine of claim 13, wherein the reference value of the unbalance amount of the drum decreases as the sensed amount of laundry increases.

15. The washing machine of claim 13, wherein the first speed is approximately 60 rpm.

16. A washing machine, comprising:

a drum that rotates laundry;

a laundry amount sensor that senses an amount of the laundry within the drum;

an unbalance amount detector that detects an unbalance amount of the drum; and a controller that:

controls the drum to rotate at a first speed at which a part of the laundry within the drum tumbles and another part of the laundry adheres to the drum;

controls the rotation of the drum to be increased from the first speed to a second speed at which substantially all of the laundry adheres to the drum when a detected unbalance amount of the drum during the rotation of the drum at the first speed is a specific value or less; and controls the rotation of the drum at the second speed, wherein the controller sets a rising slope of the rotational speed of the drum from the first speed to the second speed based on an amount of the laundry sensed during the rotation of the drum at the first speed.

17. The washing machine of claim 16, wherein the rising slope of the rotational speed of the drum from the first speed to the second speed decreases as the amount of the laundry sensed during the rotation of the drum at the first speed increases.

18. The washing machine of claim 16, wherein the first speed is approximately 60 rpm.

19. A washing machine, comprising:

a drum that rotates laundry;

a laundry amount sensor that senses an amount of the laundry within the drum;

an unbalance amount detector that detects an unbalance amount of the drum; and a controller that:

controls the drum to rotate at a first speed at which a part of the laundry within the drum tumbles and another part of the laundry adheres to the drum;

controls the rotation of the drum to be increased from the first speed to a second speed at which substantially all of the laundry adheres to the drum when an unbalance amount of the drum detected during the rotation of the drum at the first speed is a first specific value or less;

controls the rotation of the drum at the second speed; and controls the rotation of the drum to be increased from the second speed to a maximum speed when an unbalance amount of the drum detected during the rotation of the drum at the second speed is a second specific value or less, wherein the controller sets the maximum speed based on an amount of the laundry sensed during the rotation of the drum at the first speed.

20. The washing machine of claim 19, wherein the maximum speed decreases as the sensed amount of the laundry increases.

21. The washing machine of claim 19, wherein the first speed is approximately 60 rpm.

* * * * *